US005766831A

United States Patent [19]

Wildman

[11] Patent Number: 5,766,831

[45] Date of Patent: Jun. 16, 1998

[54] METHOD OF FORMING A PHOTOGRAPHIC COLOR IMAGE

[75] Inventor: Nigel Richard Wildman, Watford, United Kingdom

[73] Assignee: Eastman Kodak Company, Rochester, N.Y.

[21] Appl. No.: 686,970

[22] Filed: Jul. 25, 1996

[30] Foreign Application Priority Data

Jul. 28, 1995 [GB] United Kingdom ..... 9515514

[51] Int. Cl.[6] ..... G03C 7/42

[52] U.S. Cl. ..... 430/430; 430/373; 430/414; 430/461; 430/943

[58] Field of Search ..... 430/373, 414, 430/430, 461, 943

[56] References Cited

U.S. PATENT DOCUMENTS

| | | | |
|---|---|---|---|
| 4,045,226 | 8/1977 | Hara et al. | 430/943 |
| 4,062,684 | 12/1977 | Hara et al. | 430/943 |
| 4,069,050 | 1/1978 | Hara et al. | 430/943 |
| 4,880,725 | 11/1989 | Hirai et al. | 430/943 |
| 5,387,499 | 2/1995 | Earle et al. | 430/414 |
| 5,547,816 | 8/1996 | Fyson et al. | 430/943 |

FOREIGN PATENT DOCUMENTS

| | | | |
|---|---|---|---|
| 1539804 | 7/1975 | United Kingdom | G03C 5/42 |
| 93/01524 | 7/1991 | WIPO | G03C 7/44 |

*Primary Examiner*—Hoa Van Le

*Attorney, Agent, or Firm*—J. Lanny Tucker

[57] ABSTRACT

A color photographic material is processed first by color development, then is contacted with a solution that both bleaches and provides redox amplification.

19 Claims, No Drawings

METHOD OF FORMING A PHOTOGRAPHIC COLOR IMAGE

FIELD OF THE INVENTION

This invention relates to a process wherein a photographic color image is formed by the redox amplification process. In particular, this invention relates to processing low silver photographic materials in a color developer followed by a combined amplification and bleach bath.

BACKGROUND OF THE INVENTION

Redox amplification processes have been described, for example in British Specification No. 1,268,126 and U.S. Pat. Nos. 3,748,138, 3,822,129 and 4,097,278. In such processes color materials are developed to produce a silver image (which may contain only small amounts of silver) and then treated with a redox amplifying solution to form a dye image.

The amplifier solution contains a color developing agent and an oxidizing agent which will oxidize the color developing agent in the presence of the silver image which acts as a catalyst.

Oxidized color developer reacts with a color coupler to form the image dye. The amount of dye formed depends on the time of treatment or the availability of color coupler and is less dependent on the amount of silver in the image as is the case in conventional color development processes.

Examples of suitable oxidizing agents include peroxy compounds including hydrogen peroxide and compounds which provide hydrogen peroxide, e.g., addition compounds of hydrogen peroxide.

The image-forming step can be followed by a stop bath, bleach and fix step, although the bleach and/or fix may be omitted if the silver coating weight of the material processed is low enough. Recently it has been proposed that the bleach bath may contain a peroxide as sole bleaching agent. Such proposals have carried the warning that redox amplification has to be stopped before bleaching otherwise color staining will occur due to image formation continuing in the peroxide bleach solution.

There is a continuing need to reduce photographic processing times, reduce the number of processing baths and produce effluent which is environment friendly. The machine requirements of the present method which requires only two solutions plus fix (if used) all requiring the same processing time are much more easily retrofitted into existing machines.

SUMMARY OF THE INVENTION

According to the present invention there is provided a method of forming a color photographic image comprising:

color developing a color photographic material with a color developing solution, and contacting the material with a bleach-amplification solution for both amplification and bleaching, wherein the bleach-amplification solution has a pH of from 9 to 11.3 and comprises:

(a) hydrogen peroxide or a compound which releases hydrogen peroxide during processing, and (b) an alkali metal halide and wherein more than 50% of the final dye density is formed in the combined bleach-amplification bath.

The present invention uses a developer and a combined amplification-bleach solution. In such a process, the dye image is formed because color developing agent is carried into an bleach-amplifier bath from a developer bath in which the catalytic image silver has been previously formed. The bleach-amplifier bath provides the desired amplification and rehalogenates the image silver.

Preferably at least 65%, especially at least 70% of the dye image is formed in the bleach-amplifier bath.

Silver halide can then be removed, if desired, by fixing to leave only the dye image. Such a fixer may contain a thiosulphate or sulphite fixing agent.

ADVANTAGEOUS EFFECTS OF THE INVENTION

1. The process time can be shortened to 25 seconds (15 seconds is attainable) per stage, shortening significantly the cycle time of the process compared to previously described processes.

2. One less tank is required than a process comprising development, amplification and bleach steps.

3. The effluent contains no iron or EDTA as used in conventional bleach and bleach-fix baths.

4. Seasoning effects of the amplifier bath are reduced as the silver is bleached away, reducing the likelihood of further redox amplification caused by developing agent being carried into the amplifier bath.

5. The process reaches completion in the amplifier/bleach bath as i) the silver is bleached and ii) the developer diffuses out of the coating. Previous development-amplification processes do not reach completion and are developing at close to their maximum rate at the end of the development time.

6. The high pH makes sure that the oxidation products from carried over developer do not discolor the amplifier bath. Instead they remain almost colorless.

7. The amplifying bleach bath can be regenerated in the processing machine by the addition of hydrogen peroxide, restoring the solution's activity to that of a fresh solution.

8. The yellow dye appears much brighter due to the removal of the silver.

9. Residual silver left in the neutral Dmax areas due to incomplete bleaching helps boost the Dmax.

10. Solution stability of the separate developer and amplification-bleach solutions is much greater than the corresponding combined development-amplification providing the same process activity.

11. Increasing the silver laydown increases the bleaching rate and Dmax attained.

DETAILED DESCRIPTION OF THE INVENTION

In the present invention more than 25% of the dye density is formed in the combined bleach-amplification bath, preferably more than 50% is formed and especially more than 90% is formed. This is confirmed by measuring the dye densities before and after the bleach-amplification step and calculating the bleach-amplification step (I%) thus:

$$I\% = \frac{(\text{Final density} - \text{Density after development}) \times 100}{\text{Final density}}.$$

The combined bleach-amplification solution preferably has a pH in the range 9–11.3 especially in the range 10.5–11.2, and particularly 10.8–11.1. The alkaline agent may comprise an alkali metal carbonate or, preferably, phosphate buffer with optional use of an alkali metal hydroxide.

The combined bleach-amplification solution preferably contains from 6 to 100 ml/l of hydrogen peroxide (30% w/w) solution, preferably 50 to 75 ml/l.

The combined bleach-amplification solution preferably contains the halide in amounts of 1 to 35 g/l (as potassium chloride). The preferred halide is chloride.

It is preferred to use a fixer after the bleach-amplification bath. If used, the fixer may comprise hypo or can comprise an alkali metal sulphite as sole fixing agent.

The color developing agents that may be especially preferred are:

4-amino-3-methyl-N,N-diethylaniline hydrochloride, 4-amino-3-methyl-N-ethyl-N-β-(methanesulphonamido)-ethylaniline sulphate hydrate, 4-amino-3-methyl-N-ethyl-N-β-hydroxyethylaniline sulphate, 4-amino-3-β-(methanesulphonamido)ethyl-N,N-diethylaniline hydrochloride and 4-amino-N-ethyl-N-(2-methoxy-ethyl)-m-toluidine di-p-toluene sulphonate. The preferred color developing agent is 4-N-ethyl-N-(β-methanesulphonamidoethyl)-o-toluidine sesquisulphate.

The present developer solutions may contain antioxidants. Such compounds as hydrazines, hydroxylamines, hydroxyamic acids, oximes, nitroxy radicals, hydrazines, hydrazides, phenols, saccharides, monoamines, diamines, tertiary amines, polyamines, quaternary ammonium salts, alpha-hydroxy ketones, alcohols, diamides and disulphonamides may be used. The preferred antioxidants are hydroxylamine compounds. Many antioxidants are described in EP-A-0 410 375. The bleach-amplifier solution may also contain other compounds which increase its stability, for example a long chain compound which can adsorb to silver, e.g., dodecylamine.

The bleach-amplifier solutions may contain a hydrogen peroxide stabilizer, for example, pentetic acid (diethylenetriaminepentaacetic acid) or dipicolinic acid. Pentetic acid is preferably used in the range 0.3–1.5 g/l, preferably 0.5 to 1.0 g/l. The solutions may also contain a long chain compound which can adsorb to silver, e.g., dodecylamine. They may further contain stabilizing amounts of a surfactant such as Tween 80™ at a concentration range of 0.1 to 0.6 g/l.

A particular application of this technology is in the processing of silver chloride color paper, for example paper comprising at least 85 mole percent silver chloride, especially such paper with low silver levels, for example total silver levels below 130 mg/m$^2$, e.g., from 20 to 120 mg/m$^2$, preferably below 100 mg/m$^2$ and particularly in the range 20 to 100 mg/m$^2$. Within these total ranges the blue sensitive emulsion layer unit may comprise 20 to 60 mg/m$^2$, preferably 25 to 50 mg/m$^2$ with the remaining silver divided between the red and green-sensitive layer units, preferably more or less equally between the red and green-sensitive layer units.

The photographic elements can be single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

Suitable materials for use in this invention, can have any of the components described in Research Disclosure Item 36544, September 1994, published by Kenneth Mason Publications, Emsworth, Hants P010 7DQ, United Kingdom.

The process of the present invention may be accomplished by applying the processing solutions in any fashion. For example they may be applied by dipping, spraying, wiping, or from a roller.

Preferably the present processing solutions are used in a method of processing carried out by passing the material to be processed through a tank containing the processing solution which is recirculated through the tank at a rate of from 0.1 to 10 tank volumes per minute.

The preferred recirculation rate is from 0.5 to 8, especially from 1 to 5 and particular from 2 to 4 tank volumes per minute.

The recirculation, with or without replenishment, is carried out continuously or intermittently. In one method of working both could be carried out continuously while processing was in progress but not at all or intermittently when the machine was idle. Replenishment may be carried out by introducing the required amount of replenisher into the recirculation stream either inside or outside the processing tank.

It is advantageous to use a tank of relatively small volume. Hence in a preferred embodiment of the present invention the ratio of tank volume to maximum area of material accommodatable therein (i.e., maximum path length×width of material) is less than 11 dm$^3$/m$^2$, preferably less than 3 dm$^3$/m$^2$.

The shape and dimensions of the processing tank are preferably such that it holds the minimum amount of processing solution while still obtaining the required results. The tank is preferably one with fixed sides, the material being advanced therethrough by drive rollers. Preferably the photographic material passes through a thickness of solution less than 11 mm, preferably less than 5 mm and especially about 2 mm. The shape of the tank is not critical but it could be in the shape of a shallow tray or, preferably U-shaped. It is preferred that the dimensions of the tank be chosen so that the width of the tank is the same or only just wider than the width of the material to be processed.

The total volume of the processing solution within the processing channel and recirculation system is relatively smaller as compared to prior art processors. In particular, the total amount of processing solution in the entire processing system for a particular module is such that the total volume in the processing channel is at least 40 percent of the total volume of processing solution in the system. Preferably, the volume of the processing channel is at least about 50 percent of the total volume of the processing solution in the system.

In order to provide efficient flow of the processing solution through the opening or nozzles into the processing channel, it is desirable that the nozzles/opening that deliver the processing solution to the processing channel have a configuration in accordance with the following relationship:

$$0.6 \leqq F/A \leqq 23$$

wherein:

F is the flow rate of the solution through the nozzle in liters/minute; and

A is the cross-sectional area of the nozzle provided in square centimeters.

Providing a nozzle in accordance with the foregoing relationship assures appropriate discharge of the processing solution against the photosensitive material. Such Low Volume Thin Tank systems are described in more detail in the following patent specifications: U.S. Pat. Nos. 5,294,956, 5,179,404, 5,270,762, EP 559,025, EP 559,026, EP 559,027, WO 92/10790, WO 92/17819, WO 93/04404, WO 92/17370, WO 91/19226, WO 91/12567, WO 92/07302, WO 93/00612, WO 92/07301, and WO 92/09932

The following Examples are included for a better understanding of the invention.

EXAMPLE 1

Exposed Color photographic multilayer papers containing a total of 58 to 116 mg/m$^2$ of silver chloride emulsions were soaked in Formula 1 for 25 seconds at 35° C. These were then squeegeed and transferred to Formula 2 for 25 seconds at 35° C. The strips were then fixed for 25 seconds in C-41 Electrosilver fixer diluted 1:100, washed and dried (This fixer can also be a potassium sulphite fixer if required). The resulting red, green and blue neutral Dmax status A reflection densities were then read with a densitometer.

The residual silver, i.e., the extent of bleaching was determined by finding the red density of the yellow separation normalized at a blue separation density of 1.8 with Dmin subtracted. This red density is quoted below in the column labeled "Extent of bleaching", the lower the number, the more silver has been bleached.

Developer

| | |
|---|---|
| 1-hydroxyethylidene-1,1'-diphosphonic acid | 0.6 g/l |
| Pentetic acid | 0.81 g/l |
| $K_2HPO_4.3H_2O$ | 40 g/l |
| KCl | 1 g/l |
| KBr | 1 mg/l |
| Diethylhydroxylamine | 3.0 ml |
| 4-N-ethyl-N-(β-methanesulphonamido-ethyl)-o-toluidine sesquisulphate | 10 g/l |
| 50% w/w KOH to pH | 11.40 |

The developer could also contain hydroxylamine sulphate or other antioxidant mentioned above.

Amplifying Bleach

| | |
|---|---|
| 1-hydroxyethylidene-1,1'-diphosphonic acid | 0.6 g/l |
| Pentetic acid | 0.81 g/l |
| $K_2HPO_4.3H_2O$ | 40 g/l |
| $H_2O_2$ (30% w/w) | 20 ml/l |
| KCl | 5 g/l |
| pH | 10.9 |

The amplifying-bleach can contain di-picolinic acid as a peroxide stabilizer over the range 0.5–6.0 g/l instead of pentetic acid (DTPA).

The amplifying-bleach can also contain Dodecylamine at 0.1 g/l and Tween™ 80 at 0.3 g/l to stabilize the bleach-amplifier to solubilized silver.

The results obtained for various amplifying bleach solutions and silver laydowns are shown below.

| Silver laydown g/m$^2$ | $H_2O_2$ 30% w/w mls/l | KCL g/l | Extent of bleaching | Red Dmax | Green Dmax | Blue Dmax |
|---|---|---|---|---|---|---|
| 0.62 | 25 | 1 | 0.1 | 1.94 | 2.02 | 1.99 |
| 0.62 | 25 | 10 | 0.09 | 1.14 | 1.61 | 1.77 |
| 0.62 | 50 | 5.5 | 0.08 | 1.53 | 1.78 | 1.87 |
| 0.62 | 75 | 1 | 0.05 | 1.82 | 1.98 | 1.77 |
| 0.62 | 75 | 10 | 0.08 | 1.34 | 1.55 | 1.7 |
| 0.86 | 25 | 5.5 | 0.06 | 2.12 | 2.13 | 2.22 |
| 0.86 | 25 | 10 | 0.08 | 1.93 | 2.07 | 2.23 |
| 0.86 | 50 | 1 | 0.05 | 2.03 | 2.15 | 1.97 |
| 0.86 | 75 | 5.5 | 0.08 | 1.91 | 1.58 | 1.83 |
| 1.24 | 15 | 1 | 0.08 | 1.96 | 2.14 | 2.12 |
| 1.24 | 15 | 5 | 0.06 | 2.62 | 2.39 | 2.35 |
| 1.24* | 15 | 10 | 0.08 | 2.55 | 2.38 | 2.37 |
| 1.24* | 20 | 1 | 0.08 | 2.51 | 2.35 | 2.18 |
| 1.24* | 20 | 5 | 0.07 | 2.62 | 2.5 | 2.32 |
| 1.24* | 20 | 10 | 0.08 | 2.35 | 2.25 | 2.28 |
| 1.24* | 25 | 1 | 0.08 | 2.33 | 2.27 | 2.15 |
| 1.24* | 25 | 5.5 | 0.08 | 2.27 | 2.29 | 2.24 |
| 1.24* | 25 | 10 | 0.07 | 2.22 | 2.23 | 2.3 |
| 1.24 | 50 | 10 | 0.09 | 2.13 | 2.09 | 2.03 |
| 1.24 | 75 | 1 | 0.05 | 1.94 | 1.96 | 1.73 |
| 1.24* | 75 | 5.5 | 0.09 | 2.25 | 2.2 | 1.98 |
| 1.24 | 75 | 10 | 0.09 | 1.01 | 1.96 | 1.79 |

The emboldened line shows the optimum amplifying bleach formulation which delivers the least retained 5 silver and provides good neutral Status A Dmax values. Other combinations and their intermediaries deliver adequate responses that could be used as substitutes for this formula, and these are shown starred.

For comparison purposes an 0.62 g/m$^2$ coating processed in a Developer/amplifier described below for 45 seconds, followed by fixing and washing (as above) yields Dmax values of

| | |
|---|---|
| Cyan Dmax | 2.57 |
| Magenta Dmax | 2.28 |
| Yellow Dmax | 2.12 |

The extent of bleaching number is high at 0.107 (no bleaching) as this process does not include a bleach.

Developer/Amplifier

| | |
|---|---|
| 1-hydroxyethylidene-1,1'-diphosphonic acid | 0.6 g/l |
| Pentetic acid | 0.81 g/l |
| $K_2HPO_4.3H_2O$ | 40 g/l |
| KBr | 1 mg/l |
| KCl | 1 g/l |
| hydroxylamine sulphate | 0.6 g/l |
| 4-N-ethyl-N-(β-methanesulphonamido-ethyl)-o-toluidine sesquisulphate | 4.1 g/l |
| 50% w/w KOH to pH @ 25° C. | 11.40 |
| $H_2O_2$ (30% w/w) | 1.85 ml/l |
| Temperature | 35° C. |

EXAMPLE 2

The following experiments were performed to show the percentage dye produced in the amplification bath with respect to the initial densities formed in the developer.

Strips of low silver color papers containing a total of 58, 89 and 103 mg/m$^2$ total silver chloride emulsion were exposed to a normal 21 step 0.15 increment step wedge for 0.1 second with a standard filter pack. These strips were developed in the developer of Example 1 for 25 seconds and then squeegeed and transferred to amplifying bleach of Example 1 for 25 seconds. The strips were then fixed and washed as described before. Following the wash these strips were then bleach-fixed in Ektacolor RA bleach fix to remove all of the silver from the strips.

Another set of the above coatings were processed this time in only the developer of Example 1 for 25 seconds, followed by a 25 second running water wash to remove developing agent and then they were bleach-fixed in Ektacolor RA bleach fix and washed as before.

This gave two sets of strips, one set developed and amplified and the other just developed, neither set contained silver in the image.

The results are expressed as % of total dye formed in the amplifying-bleach bath with respect to the developer. The densities quoted are Status A reflection densities.

The result for any layer is given by:

$$\% \text{ dye formed} = 100 \times (D1 - D2)/D1$$

where D1 is the Density after development and amplification, and

D2 is the Density after development only.

The dye densities D1 and D2 formed are shown for three silver laydowns for each of the three color forming records in the neutral and separation exposures.

| Silver coating weight mg/m$^2$ | Neutral Cyan | Neutral Magenta | Neutral Yellow | Separation Cyan | Separation Magenta | Separation Yellow | Mean % dye formed |
|---|---|---|---|---|---|---|---|
| 89 D1 | 2.47 | 2.43 | 2.05 | 2.75 | 2.63 | 2.11 | |
| 89 D2 | 0.69 | 0.71 | 0.79 | 0.67 | 0.61 | 0.60 | |
| % Dye | 72 | 70.8 | 61.5 | 75.6 | 76.8 | 71.6 | 71.4 |
| 58 D1 | 1.92 | 2.08 | 1.98 | 2.52 | 2.40 | 1.91 | |
| 58 D2 | 0.49 | 0.53 | 0.65 | 0.47 | 0.45 | 0.45 | |
| % Dye | 74.5 | 74.5 | 67.17 | 81.4 | 81.3 | 69.6 | 74.7 |
| 103 D1 | 2.42 | 2.49 | 2.22 | 2.75 | 2.56 | 2.18 | |
| 103 D2 | 0.73 | 0.81 | 0.98 | 0.73 | 0.67 | 0.89 | |
| % Dye | 69.8 | 67.5 | 55.8 | 73.5 | 73.8 | 59.2 | 66.6 |

The invention has been described in detail with particular reference to preferred embodiments thereof, but it will be understood that variations and modifications can be effected within the spirit and scope of the invention.

I claim:

1. A method of forming a color photographic image comprising:

color developing a color photographic material with a color developing solution, and thereafter contacting said material with a bleach-amplification solution for both amplification and bleaching, wherein said bleach-amplification solution has a pH of from 9 to 11.3 and (a) hydrogen peroxide or a compound which releases hydrogen peroxide during processing, and (b) an alkali metal halide in an amount of 1 to 35 g/l, and wherein more than 50% of the final dye density is formed in the combined bleach-amplification bath.

2. The method of claim 1 wherein said bleach-amplification solution has a pH of from 10.5 to 11.2.

3. The method of claim 1 wherein said alkali metal halide is potassium chloride.

4. The method of claim 1 wherein said bleach-amplification solution contains from 6 to 100 ml/l of hydrogen peroxide (30% w/w) solution.

5. The method of claim 1 wherein said color developer solution contains from 5 to 12 g/l of color developing agent.

6. The method of claim 1 wherein said color photographic material is a silver chloride color paper wherein at least 85 mole percent of the silver halide is silver chloride.

7. The method of claim 6 wherein the total silver halide coating weight of said photographic material is from 20 to 120 mg silver per m$^2$.

8. The method of claim 1 carried out by passing said photographic material through a tank containing said bleach-amplification solution which is recirculated through the tank at a rate of from 0.1 to 10 tank volumes per minute.

9. The method of claim 1 carried out in a processor wherein the ratio of tank volume to maximum area of said photographic material accommodatable therein (i.e., maximum path length x width of material) is less than 11 dm$^3$/m$^2$.

10. The method of claim 9 wherein said ratio of tank volume to maximum area of said photographic material is less than 3 dm$^3$/m$^2$.

11. The method of claim 1 wherein more than 90% of the final dye density is formed in said combined bleach-amplification bath.

12. The method of claim 2 wherein said bleach-amplification solution has a pH of from 10.8 to 11.1.

13. The method of claim 4 wherein said bleach-amplification solution contains from 50 to 75 ml/l of hydrogen peroxide (30% w/w) solution.

14. The method of claim 1 wherein said bleach-amplification solution further comprises a hydrogen peroxide stabilizer in an amount of from 0.3 to 1.5 g/l.

15. The method of claim 13 wherein said hydrogen peroxide stabilizer is pentetic acid or dipicolinic acid.

16. The method of claim 1 wherein said bleach-amplification solution further comprises a long chain compound that can absorb to silver, or a surfactant.

17. The method of claim 1 wherein the total silver halide coating weight of said photographic material is from 20 to 100 mg silver per m$^2$.

18. The method of claim 1 wherein said photographic material is a multicolor element comprising red, green and blue light sensitive units, and the silver coverage in said blue light sensitive unit is from 20 to 60 mg/m$^2$.

19. The method of claim 1 further comprising fixing said photographic material after it has been contacted with said bleach-amplification solution.

* * * * *